US007544006B2

(12) United States Patent
Massimi

(10) Patent No.: US 7,544,006 B2
(45) Date of Patent: Jun. 9, 2009

(54) PAINT OR VARNISH FEEDER AND PAINTING DEVICE COMPRISING SAID FEEDER

(76) Inventor: Giacomo Massimi, Via Giovanni XXIII, 46, 20090 Milan (IT)

( * ) Notice: Subject to any disclaimer, the term of this patent is extended or adjusted under 35 U.S.C. 154(b) by 547 days.

(21) Appl. No.: 10/556,749

(22) PCT Filed: Jan. 30, 2004

(86) PCT No.: PCT/EP2004/000846

§ 371 (c)(1),
(2), (4) Date: Nov. 14, 2005

(87) PCT Pub. No.: WO2004/101172

PCT Pub. Date: Nov. 25, 2004

(65) Prior Publication Data

US 2007/0031178 A1 Feb. 8, 2007

(30) Foreign Application Priority Data

May 15, 2003 (IT) ..... MI2003A0968

(51) Int. Cl.
*A46B 11/00* (2006.01)
*B43M 11/02* (2006.01)

(52) U.S. Cl. ..... 401/11; 401/9; 401/219

(58) Field of Classification Search ..... 401/9, 401/11, 12, 197, 208, 219, 220; 118/258, 118/259

See application file for complete search history.

(56) References Cited

U.S. PATENT DOCUMENTS

| | | | | |
|---|---|---|---|---|
| 2,898,618 | A | 8/1959 | Whitfield et al. | |
| 3,310,831 | A | 3/1967 | Brinker | |
| 3,441,355 | A * | 4/1969 | Brown | 401/219 |
| 4,566,816 | A | 1/1986 | Janssen | |
| 6,422,778 | B2 * | 7/2002 | Baumann et al. | 401/266 |

OTHER PUBLICATIONS

PCT International Search Report for Application PCT/EP2004/000846.

Written Opinion of the International Searching Authority for Application PCT/EP2004/000846.

* cited by examiner

*Primary Examiner*—David J Walczak
(74) *Attorney, Agent, or Firm*—Sheridan Ross P.C.

(57) ABSTRACT

A paint or varnish feeder (2) for a roller painting device (1), which comprises at least one hollow manifold (7) with openings (8) to deliver and to distribute the paint or the varnish to the roller (5) of the painting device (1), is described. The feeder (2) has, on a flat face (14) destined to come into contact with the roller (5), a hollow surface (12), shaped as an arc of a circle, along the longitudinal axis of which there is a groove (13) connected to the at least one manifold (7) by at least one opening (8). The hollow surface (12) advantageously has a radius no smaller than that of the largest sized roller (5) with which the feeder (2) is destined to come into contact. There is further described a painting device (1) comprising said feeder (2).

12 Claims, 1 Drawing Sheet

PAINT OR VARNISH FEEDER AND PAINTING DEVICE COMPRISING SAID FEEDER

The present invention refers to the field of roller devices for applying paint or varnish to a surface, particularly but not exclusively for painting walls both vertical and horizontal (floors or ceilings).

It is known to use—for example, to whitewash a wall—a roller which is used by dipping it into a recipient containing the paint, then by eliminating the excess paint with various expedients and finally by passing the roller over the wall several times until the paint it carries is used up, after which the roller is dipped into the recipient again.

The system used leaves much room for personal skill and experience, which means that a beginner will easily obtain poor or uneven results.

Furthermore, the amount of paint or of varnish distributed is not even with each brushstroke but it gradually decreases from the first stroke to the last one before the brush is dipped again.

In addition, the movements necessary to supply again the roller with paint lead to a waste of energy and of time.

To overcome these drawbacks there are known and available on the market painting devices comprising so-called "feeders" which, connected to a tank containing the paint or the varnish and placed in contact with the roller, pick up from the tank and supply to the roller the amount of paint or of varnish necessary each time, eliminating (or at least drastically reducing) and/or the risk that part of the paint or of the varnish may leak from the painting device dripping onto the user, the walls and/or the ground.

Operation of a feeder will not be described here because it is per se known.

It has nevertheless been noted that, at least in certain conditions of use (for example when painting a ceiling), the already known feeders are not able to avoid the paint dripping—or being able to drip—on the operator and/or on the ground.

Object of the present invention is a feeder for a roller painting device suitable to avoid this risk.

A feeder according to the present invention is disclosed in independent claim 1; further characteristics of said feeder are disclosed in the dependent claims.

The present invention further includes a painting device provided with a feeder (or applicator) made according to the present invention.

The invention achieves the above object, in particular it allows a controlled delivery of paint or of varnish onto the roller of the painting device without the need to perform tiring and time-consuming movements; furthermore, it has been seen experimentally that it allows more even results to be achieved than those that can be achieved with traditional painting.

An exemplary embodiment of the invention will be described below purely by way of non-limiting example and with reference to the appended drawings, in which.

In the appended figures corresponding elements shall be identified by the same reference numerals.

Figure 1:
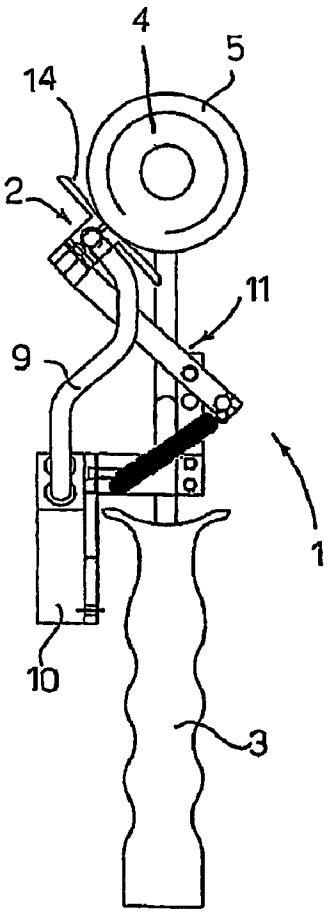
FIG. 1 shows diagrammatically a side view of a roller painting device—per se known—comprising a feeder made according to the invention.
Figure 2:
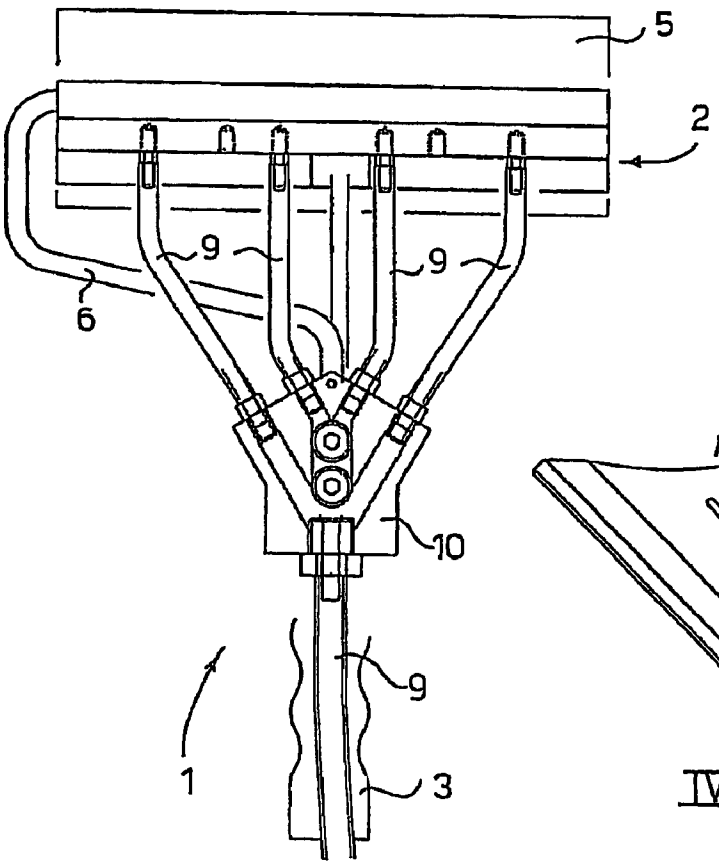
FIG. 2 shows diagrammatically a top view of the painting device of FIG. 1.

FIGS. 1 and 2, respectively, show a side view and a top view of a roller painting device indicated as a whole with reference numeral 1 and comprising a feeder 2 made according to the invention.

The painting device 1 comprises a handle 3 which carries a roller-type head 4 consisting of a roller 5 of conventional type—able to rotate on a supporting frame 6 integral with the handle 3—and of the feeder 2, comprising at least one hollow manifold 7 (FIGS. 3 and 4) that comprises one or more chambers with paint or varnish distribution openings 8 made in the flat face 14 destined to come into contact with the roller 5 and which is connected to the paint or varnish tank by flexible supply hoses 9.

The hollow manifold 7 receives the paint or the varnish from the flexible supply hoses 9 and delivers it to the roller 5 through the openings 8.

In the painting device shown in FIGS. 1 and 2, the at least one chamber of the manifold 7 receives the paint or the varnish through a distributor 10 and the feeder 2 is carried by means 11 able to bring it into contact with the roller 5—respectively away from the roller 5—only on user's command; the distributor 10 and the means 11 will not be described herein because they are per se known and in any case outside the scope of the present invention.

Figure 3:
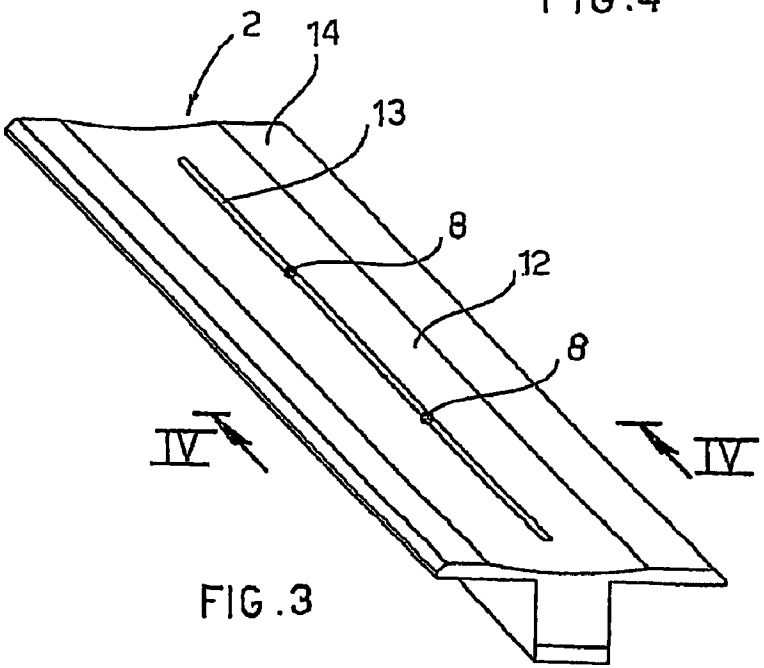
FIG. 3 is an axonometric view of the feeder of FIG. 1.

FIG. 3 is an axonometric view of the feeder 2 of FIG. 1, which has on the flat face 14 destined to come into contact with the roller 5 a hollow surface 12, shaped as an arc of a circle, along the axis of which a groove 13 connected to the at least one manifold 7 by at least one distribution opening 8 is present.

The hollow surface 12 allows the feeder 2 to "embrace" the roller 5 better than the feeders of the prior art, thus eliminating the risk of unwanted leakage of the varnish or of the paint.

In order to confer a greater elasticity of use on a feeder 2 made according to the invention, the hollow surface 12 advantageously has a radius not smaller than that of the largest sized roller 5 with which the feeder 2 is destined to come into contact.

The depth of the groove 13 is preferably about 3 mm and in any case comprised between about 2.5 mm and about 3.5 mm, whilst its width is about 0.6 mm and in any case comprised between about 0.5 mm and about 2 mm; the distribution openings 8 have a diameter of about 6 mm and in any case comprised between about 4 mm and about 8 mm.

Figure 4:
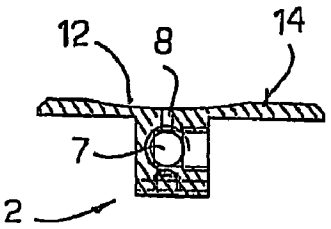
FIG. 4 is a side view of the feeder of FIG. 1 sectioned along the plane IV-IV of FIG. 3.

FIG. 4 is a side view of the feeder 2 of FIG. 1 sectioned along the plane IV-IV of FIG. 3: in FIG. 4 the manifold 7, the hollow surface 12 and a paint or varnish distribution opening 8 can be seen, whilst the longitudinal groove 13, corresponding to the area of the opening 8 immediately adjacent the hollow surface 12, is not explicitly indicated.

Without departing from the scope of the invention, two or more feeders 2 supplied with different paints or varnishes can be applied to the same roller 5.

The present invention further includes a painting device 1, like that illustrated in FIGS. 1 and 2, comprising a feeder 2 made according to the present invention.

Other possible variants with respect to what is described may occur to a person skilled in the art; however, said variants accessible to a person skilled in the art are understood as included in the scope of the invention as defined in the appended claims.

The invention claimed is:

1. A feeder for delivering at least one of a paint and a varnish to a roller of a roller device comprising:

at least one hollow manifold with at least one opening to deliver and to distribute the at least one of the paint and the varnish to the roller of the roller device;

a flat face portion positioned on opposite sides of a substantially arced portion which is recessed from a plane defined by the flat faced portion proximate the at least one opening, wherein the substantially arced portion is configured for contacting the roller, wherein along a longitudinal axis of the substantially arced portion there is a groove connected to the at least one manifold by the at least one opening, and wherein the flat face portion is configured such that it does not contact the roller when a roller is attached to the feeder.

2. The feeder according to claim 1, wherein the substantially arced portion has a radius no smaller than a largest radius of the roller with which the feeder is destined to come into contact.

3. The feeder according to claim 1, wherein a depth of the groove is comprised between about 2.5 mm and 3.5 mm.

4. The feeder according to claim 3, wherein the depth of the groove is about 3 mm.

5. The feeder according to claim 1, wherein a width of the groove is comprised between about 0.5 mm and about 2 mm.

6. The feeder according to claim 5, wherein the width of the groove is about 0.6 mm.

7. The feeder according to claim 1, wherein the at least one opening has a diameter comprised between about 4 mm and 8 mm.

8. The feeder according to claim 7, wherein the diameter of the at least one opening is about 6 mm.

9. A product, comprising the feeder as claimed in claim 1, wherein the product is a painting device.

10. The feeder according to claim 1, further comprising:

a plurality of flexible supply hoses, wherein each flexible supply hose is connected to the hollow manifold proximate to different points along the groove of the flat face.

11. The feeder according to claim 1, further comprising a plurality of openings along the manifold, each opening connected to the groove to distribute the at least one of a paint and the varnish to the roller.

12. The feeder according to claim 1, wherein the groove is substantially parallel to the axis of rotation of the roller.

* * * * *